US012311227B2

(12) United States Patent
Cheng et al.

(10) Patent No.: US 12,311,227 B2
(45) Date of Patent: May 27, 2025

(54) MAGNETIC ACTUATOR AND REHABILITATION DEVICE HAVING THE SAME

(71) Applicant: National Tsing Hua University, Hsinchu (TW)

(72) Inventors: Li-Wei Cheng, Hsinchu (TW); Zhi-Yong Chen, Hsinchu (TW); Jen-Yuan Chang, Hsinchu (TW)

(73) Assignee: National Tsing Hua University

( * ) Notice: Subject to any disclaimer, the term of this patent is extended or adjusted under 35 U.S.C. 154(b) by 173 days.

(21) Appl. No.: 18/454,577

(22) Filed: Aug. 23, 2023

(65) Prior Publication Data

US 2025/0001248 A1 Jan. 2, 2025

(30) Foreign Application Priority Data

Jun. 29, 2023 (TW) ..... 112124348

(51) Int. Cl.
*A63B 23/14* (2006.01)
*A63B 21/00* (2006.01)

(52) U.S. Cl.
CPC ..... *A63B 23/14* (2013.01); *A63B 21/00192* (2013.01); *A63B 21/4033* (2015.10)

(58) Field of Classification Search
CPC .. A63B 23/14; A63B 21/0058; A63B 21/0059
See application file for complete search history.

(56) References Cited

U.S. PATENT DOCUMENTS

| | | | | |
|---|---|---|---|---|
| 8,957,641 | B1 * | 2/2015 | Hsu | A63B 24/0087 322/4 |
| 2010/0041520 | A1 * | 2/2010 | Popescu | A63B 23/1209 482/37 |
| 2019/0181715 | A1 * | 6/2019 | McMillan | H02K 5/148 |
| 2020/0274431 | A1 | 8/2020 | Abbott et al. | |

(Continued)

FOREIGN PATENT DOCUMENTS

| | | | |
|---|---|---|---|
| CN | 111065895 A | | 4/2020 |
| CN | 116054440 A | * | 5/2023 |
| TW | 1539106 B | * | 6/2016 |

OTHER PUBLICATIONS

Taiwanese Search Report for Taiwanese Application No. 112124348, dated Feb. 6, 2024, with English translation.

*Primary Examiner* — Zachary T Moore
(74) *Attorney, Agent, or Firm* — Birch, Stewart, Kolasch & Birch, LLP

(57) ABSTRACT

A rehabilitation device is adapted for wrist rehabilitation, and includes two magnetic actuators and a movable frame unit. Each of the magnetic actuator includes a motor, a rotating shaft, a rotating member, and two magnetic coupling subunits that are respectively connected to the motor and the rotating shaft. Each of the magnetic coupling subunits includes a magnetic ring that has a plurality of N pole portions and a plurality of S pole portions alternately arranged about a center of the magnetic ring. For each of the magnetic actuators, when one of the magnetic coupling subunits that is connected to the motor is driven by the motor to rotate, the other one of the magnetic coupling subunits that is connected to the rotating shaft is urged to rotate by attraction between the magnetic rings of the magnetic coupling subunits such that the rotating shaft and the rotating member rotate.

18 Claims, 14 Drawing Sheets

(56) References Cited

U.S. PATENT DOCUMENTS

| | | | | |
|---|---|---|---|---|
| 2023/0310940 | A1* | 10/2023 | Lee | A63B 21/0058 482/4 |
| 2024/0266935 | A1* | 8/2024 | Fiedler | H02K 33/16 |
| 2025/0010127 | A1* | 1/2025 | Lee | A63B 21/0051 |

* cited by examiner

MAGNETIC ACTUATOR AND REHABILITATION DEVICE HAVING THE SAME

CROSS-REFERENCE TO RELATED APPLICATION

This application claims priority to Taiwanese Invention patent application Ser. No. 11/212,4348, filed on Jun. 29, 2023.

FIELD

The disclosure relates to an actuator, and more particularly to a magnetic actuator and a rehabilitation device having the magnetic actuator.

BACKGROUND

Nowadays, a conventional rehabilitation machine for wrist rehabilitation generally includes a driving system and an actuator that have high stiffness. Therefore, it may be difficult for a physical therapist to fit a patient's injured arm into the conventional rehabilitation machine because degrees of joint stiffness and position of wrist vary from patients to patients. In addition, during rehabilitation, if the patient suddenly feels pain and then resists movements of the conventional rehabilitation machine, the conventional rehabilitation machine may not be able to stop generating torque exerted on the patient because the actuator is not elastic/soft enough.

Furthermore, the movements of the conventional rehabilitation machine include continuous passive motion (CPM) and active-resisted movement (ARM). The continuous passive motion is a therapy in which the patient is urged by the conventional rehabilitation machine to move repetitively so as to relieve joint stiffness and to regain muscle tension, and is a therapy that is commonly used in an early stage of the rehabilitation (i.e., a therapy for patients with a high degree of joint stiffness). The active-resisted movement is a therapy that helps the patients whose joint mobility has started to recover by providing the patients with weight training exercises so that the patients' muscles may grow, their activities of daily living (ADL) may restart, and the same injury may be prevented. All in all, these therapies require the conventional rehabilitation machine to generate and exert forces on the patients. However, size of the conventional rehabilitation machine may be too large when it includes an apparatus used for adjusting the exerted forces during the active-resisted movement.

SUMMARY

Therefore, an object of the disclosure is to provide a magnetic actuator that can alleviate at least one of the drawbacks of the prior art.

According to the disclosure, the magnetic actuator includes a base seat, a motor, a rotating unit, and a magnetic coupling unit. The motor is disposed on the base seat. The rotating unit includes a rotating shaft that is rotatably disposed on the base seat, a rotating member that is sleeved on the rotating shaft, and an angle position sensor that is sleeved on the rotating shaft. The magnetic coupling unit is connected to the motor and is drivable by the motor to rotate. The magnetic coupling unit includes two magnetic coupling subunits that are respectively connected to the motor and the rotating shaft. Each of the magnetic coupling subunits includes a magnetic ring that has a plurality of N pole portions and a plurality of S pole portions which are alternately arranged about a center of the magnetic ring. The N pole portions of the magnetic ring of one of the magnetic coupling subunits respectively correspond in position to the S pole portions of the magnetic ring of the other one of the magnetic coupling subunits. When one of the magnetic coupling subunits that is connected to the motor is driven by the motor to rotate, the other one of the magnetic coupling subunits that is connected to the rotating shaft is urged to rotate by attraction between the magnetic rings of the magnetic coupling subunits such that the rotating shaft and the rotating member rotate.

Another object of the disclosure is to provide a rehabilitation device that can alleviate at least one of the drawbacks of the prior art.

According to an aspect of the disclosure, the rehabilitation device is adapted for wrist rehabilitation, and includes two of the magnetic actuators as mentioned above, a movable frame unit, and two pairs of cables. The movable frame unit includes two standing plates, a first movable frame, and a second movable frame. The standing plates are spaced apart from each other in a first direction. The first movable frame is rotatably mounted to the standing plates, and is rotatable relative to the standing plates about a first axis extending in the first direction. The second movable frame is rotatably mounted to the first movable frame, and is rotatable relative to the first movable frame about a second axis of the first movable frame orthogonal to the first axis. The first movable frame includes a first frame body, and a first rotation member that is fixedly mounted to the first frame body and that is rotatably mounted to one of the standing plates. The second movable frame includes a second frame body, and a second rotation member that is fixedly mounted to the second frame body, that is rotatably mounted to the first frame body, and that is located below the first frame body. One of the pairs of the cables interconnects the first rotation member and one of the magnetic actuators so that the first movable frame is drivable by the one of the magnetic actuators to rotate. The other one of the pairs of the cables interconnects the second rotation member and the other one of the magnetic actuators so that the second movable frame is drivable by the other one of the magnetic actuators to rotate.

According to another aspect of the disclosure, the rehabilitation device is adapted for finger rehabilitation, and includes the magnetic actuator as mentioned above, a base frame unit, a linkage unit, a joint actuation unit, and two cables. The base frame unit includes a lower abutting plate, two side standing plates that are disposed on the lower abutting plate and that are spaced apart from each other, a sliding block that is movably disposed between the side standing plates and that has two opposite ends, and a first pushing member that is movably disposed on the lower abutting plate. The linkage unit interconnects the sliding block and the first pushing member, and is movable relative to the base frame unit. The joint actuation unit is adapted for a finger of a patient to abut against. The joint actuation unit interconnects the first pushing member and the linkage unit. The joint actuation unit is adapted to urge the finger of the patient to bend when being pushed by the first pushing member and the linkage unit. One of the cables interconnects the magnetic actuator and one of the ends of the sliding block. The other one of the cables interconnects the magnetic actuator and the other one of the ends of the sliding block. The magnetic actuator is operable to urge the sliding block to move so that the sliding block urges the linkage unit and the first pushing member to move. The joint actuation unit is adapted to urge the finger of the patient to bend when the linkage unit and the first pushing member are urged by the sliding block to move, to push the joint actuation unit, and to urge the joint actuation unit to bend.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
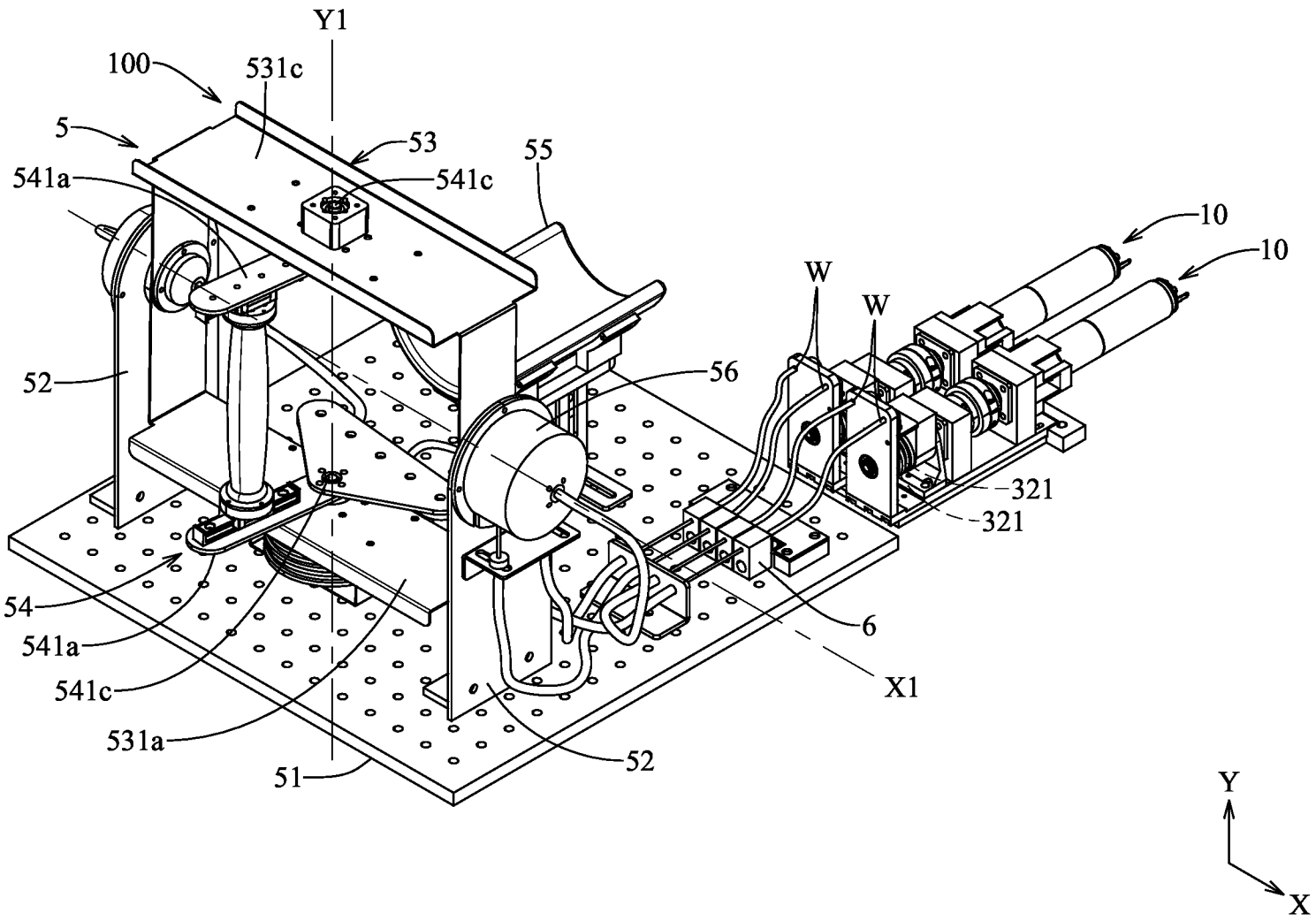
FIG. 1 is a perspective view of a first embodiment of a rehabilitation device according to the disclosure.
Figure 2:
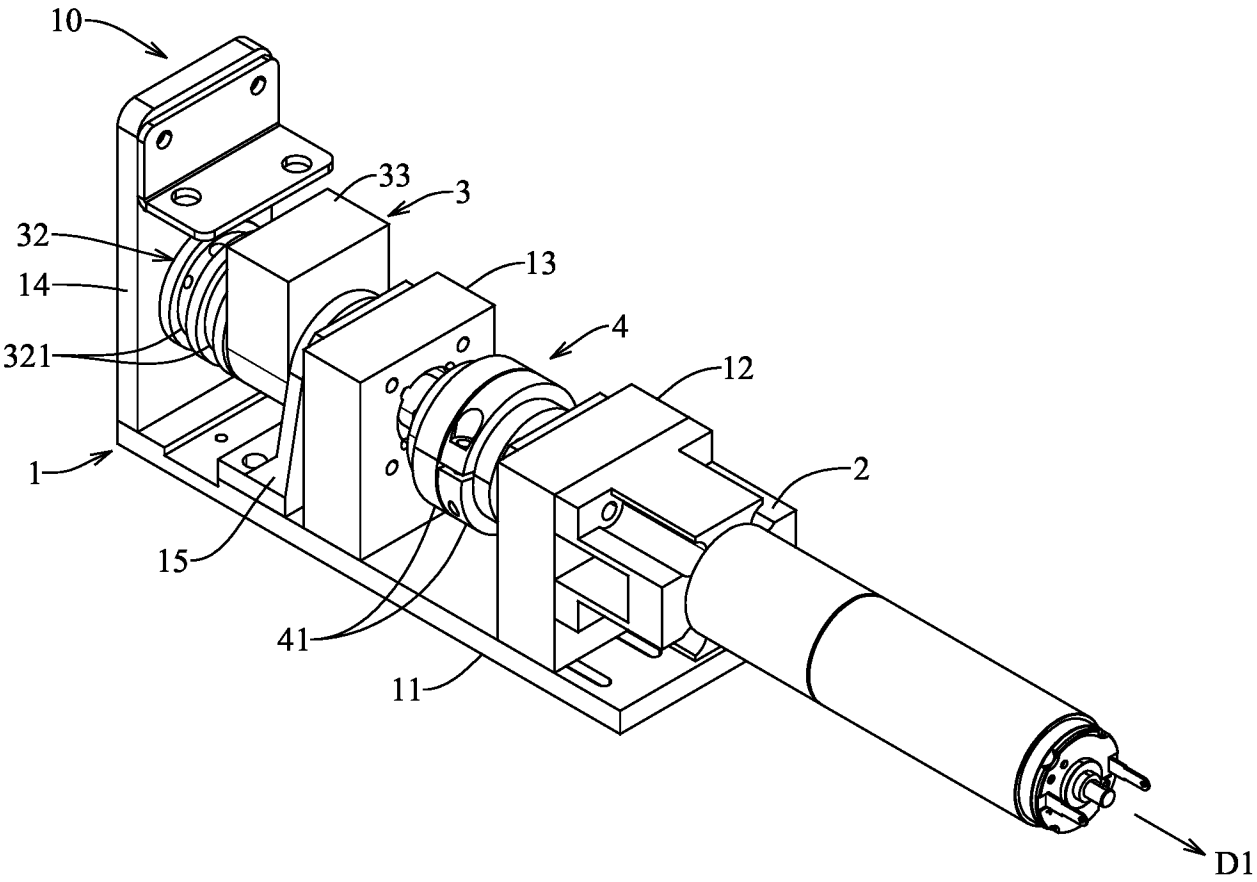
FIG. 2 is a perspective view of a magnetic actuator of the first embodiment.
Figure 3:
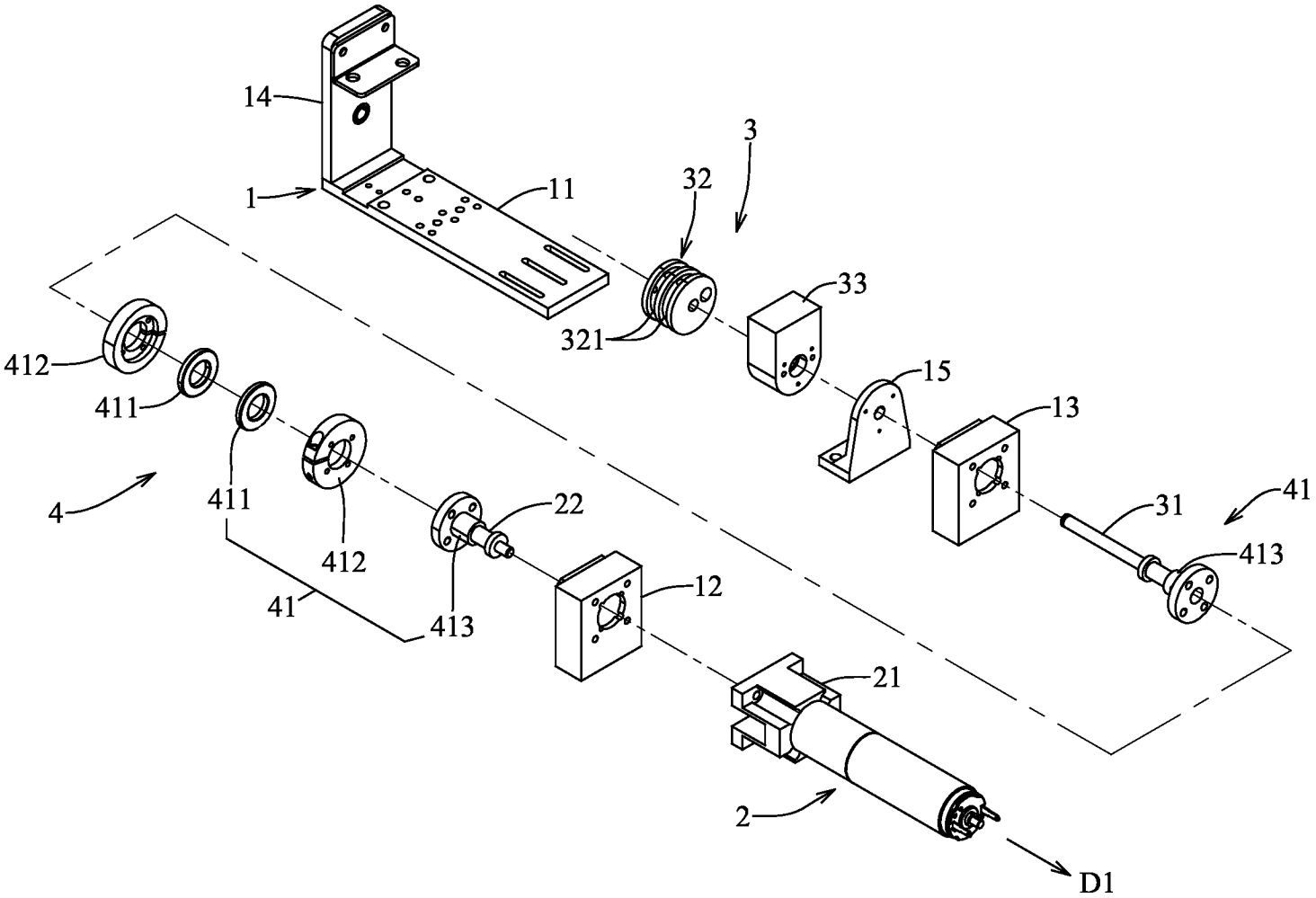
FIG. 3 is a partly exploded perspective view of the magnetic actuator.
Figure 4:
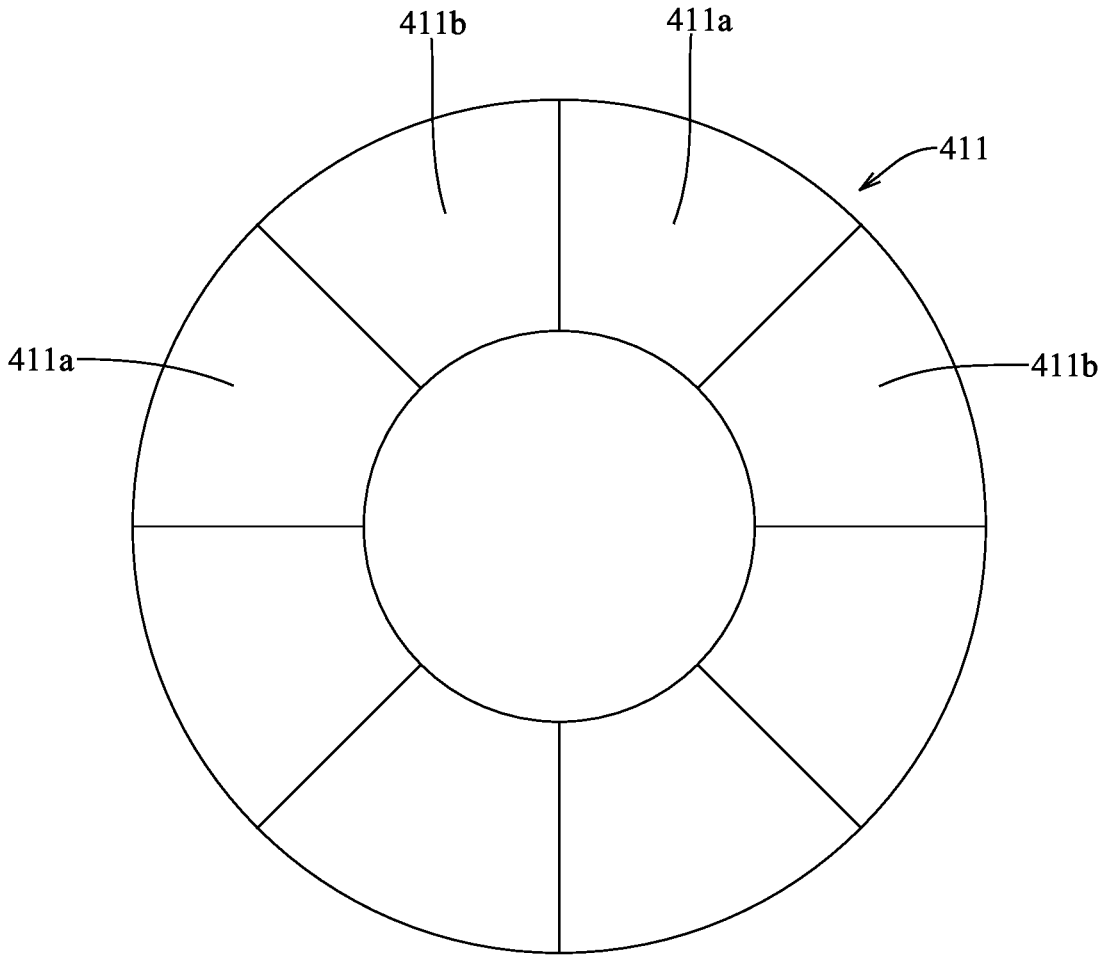
FIG. 4 is a schematic view of a magnetic ring of a magnetic coupling subunit of the magnetic actuator.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Referring to FIGS. 1 to 4, a first embodiment of a rehabilitation device 100 according to the disclosure is adapted for wrist rehabilitation (i.e., the rehabilitation device 100 helps a patient to rehabilitate his/her wrist). The rehabilitation device 100 includes two magnetic actuators 10, a movable frame unit 5, a tension regulator 6, and two pairs of cables (W).

Each of the magnetic actuator 10 includes a base seat 1, a motor 2, a rotating unit 3, and a magnetic coupling unit 4. The base seat 1 includes a main plate 11, a first bearing plate 12, a second bearing plate 13, a third bearing plate 14, and a mounting plate 15. The first bearing plate 12 is disposed on the main plate 11. The second bearing plate 13 is disposed on the main plate 11 and is spaced apart from the first bearing plate 12. The third bearing plate 14 is disposed on the main plate 11 and is spaced apart from the second bearing plate 13. The mounting plate 15 is disposed on the main plate 11, and is located between the second bearing plate 13 and the third bearing plate 14. The motor 2 includes a motor main body 21 that is disposed on the first bearing plate 12 of the base seat 1, and a motor output shaft 22 that is connected to the motor main body 21, that extends through the first bearing plate 12, and that is connected to the magnetic coupling unit 4.

For each of the magnetic actuators 10, the rotating unit 3 includes a rotating shaft 31 that is rotatably disposed on the base seat 1, a rotating member 32 that is sleeved on the rotating shaft 31, and an angle position sensor 33 that is sleeved on the rotating shaft 31. The rotating shaft 31 is elongated in a longitudinal direction (D1), extends through the second bearing plate 13 and the mounting plate 15, and is inserted into the third bearing plate 14. It is noted that, in one embodiment, the rotating shaft 31 may extend through the third bearing plate 14. The angle position sensor 33 is disposed on the mounting plate 15. The rotating member 32 has two grooves 321 that are formed in an outer circumferential surface thereof. The cables (W) in each pair wind around the grooves 321 of the rotating member 32 of a respective one of the magnetic actuators 10.

For each of the magnetic actuators 10, the magnetic coupling unit 4 is connected to the motor 2 and is drivable by the motor 2 to rotate. The magnetic coupling unit 4 includes two magnetic coupling subunits 41 that are respectively connected to the motor 2 and the rotating shaft 31. The magnetic coupling subunits 41 are located between the first bearing plate 12 and the second bearing plate 13. Each of the magnetic coupling subunits 41 includes a magnetic ring 411, an outer housing 412 that covers the magnetic ring 411, and an interconnecting member 413 that is connected to the outer housing 412. For each of the magnetic actuators 10, the interconnecting member 413 of the one of the magnetic coupling subunits 41 that is connected to the motor 2 interconnects the outer housing 412 of the one of the magnetic coupling subunits 41 and the motor 2, and the interconnecting member 413 of the other one of the magnetic coupling subunits 41 that is connected to the rotating shaft 31 interconnects the outer housing 412 of the other one of the magnetic coupling subunits 41 and the rotating shaft 31. For each of the magnetic actuators 10, the magnetic rings 411 are spaced apart from each other in the longitudinal direction (D1), and each of the magnetic ring 411 has a plurality of N pole portions 411*a* and a plurality of S pole portions 411*b* that are alternately arranged about a center of the magnetic ring 411. For each of the magnetic actuators 10, the N pole portions 411*a* of the magnetic ring 411 of one of the magnetic coupling subunits 41 respectively correspond in position to the S pole portions 411*b* of the magnetic ring 411 of the other one of the magnetic coupling subunits 41 (not shown). For each of the magnetic actuators 10, when the one of the magnetic coupling subunits 41 that is connected to the motor 2 is driven by the motor 2 to rotate, the other one of the magnetic coupling subunits 41 that is connected to the rotating shaft 31 is urged to rotate by magnetic attraction between the magnetic rings 411 of the magnetic coupling subunits 41 such that the rotating shaft 31 and the rotating member 32 rotate.

Figure 5:
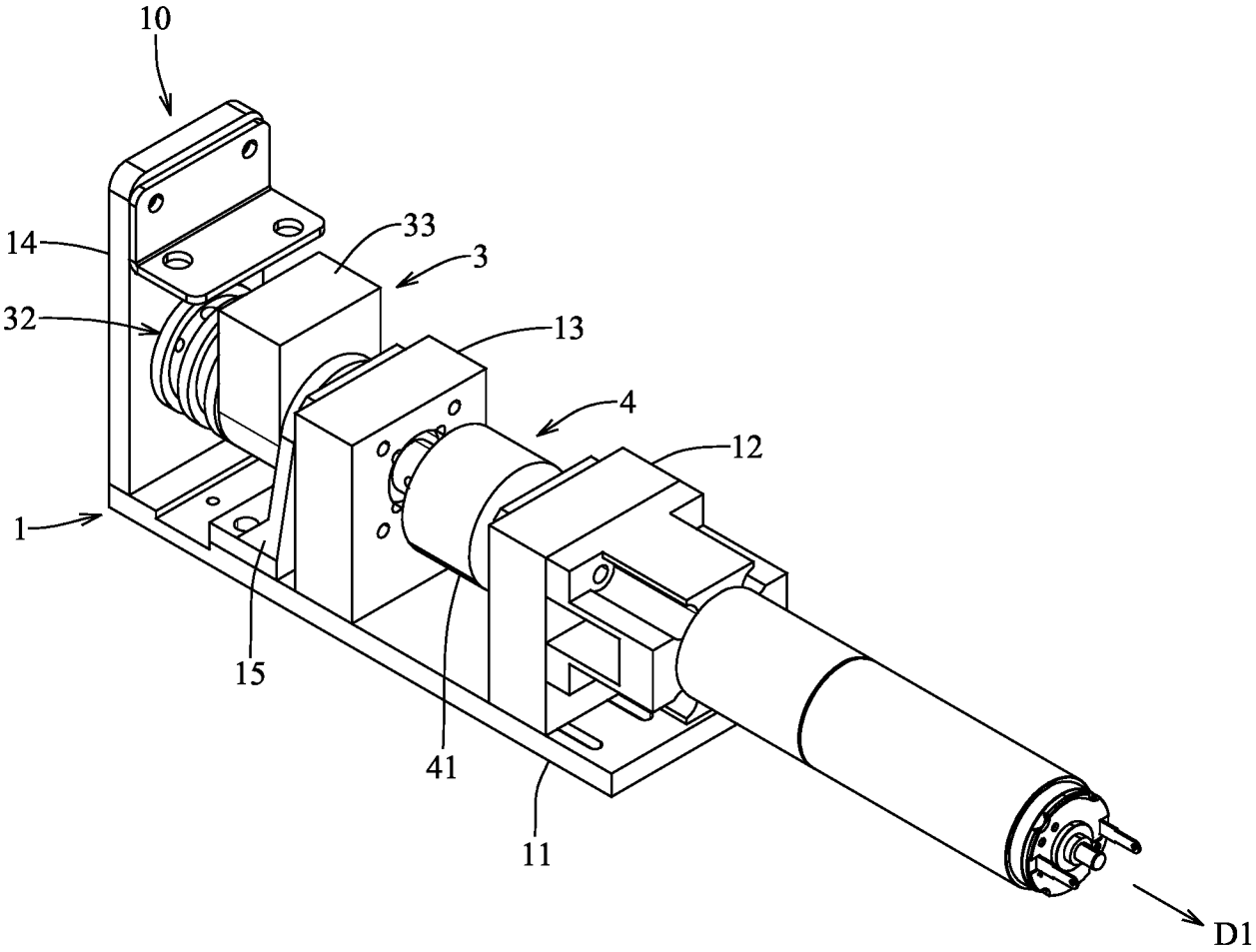
FIG. 5 is a perspective view of a modification of the magnetic actuator.
Figure 6:
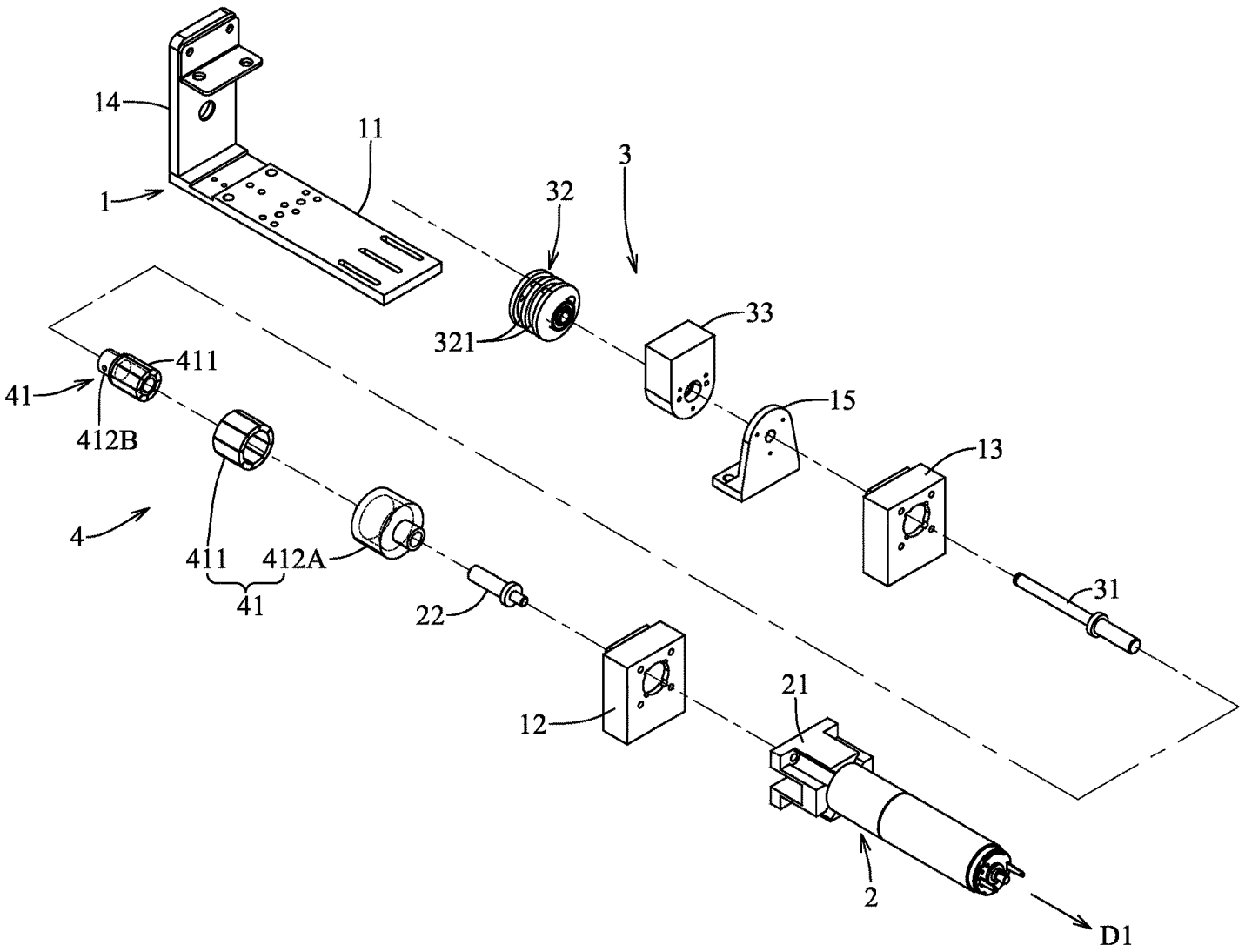
FIG. 6 is a partly exploded perspective view of the modification of the magnetic actuator.
Figure 7:
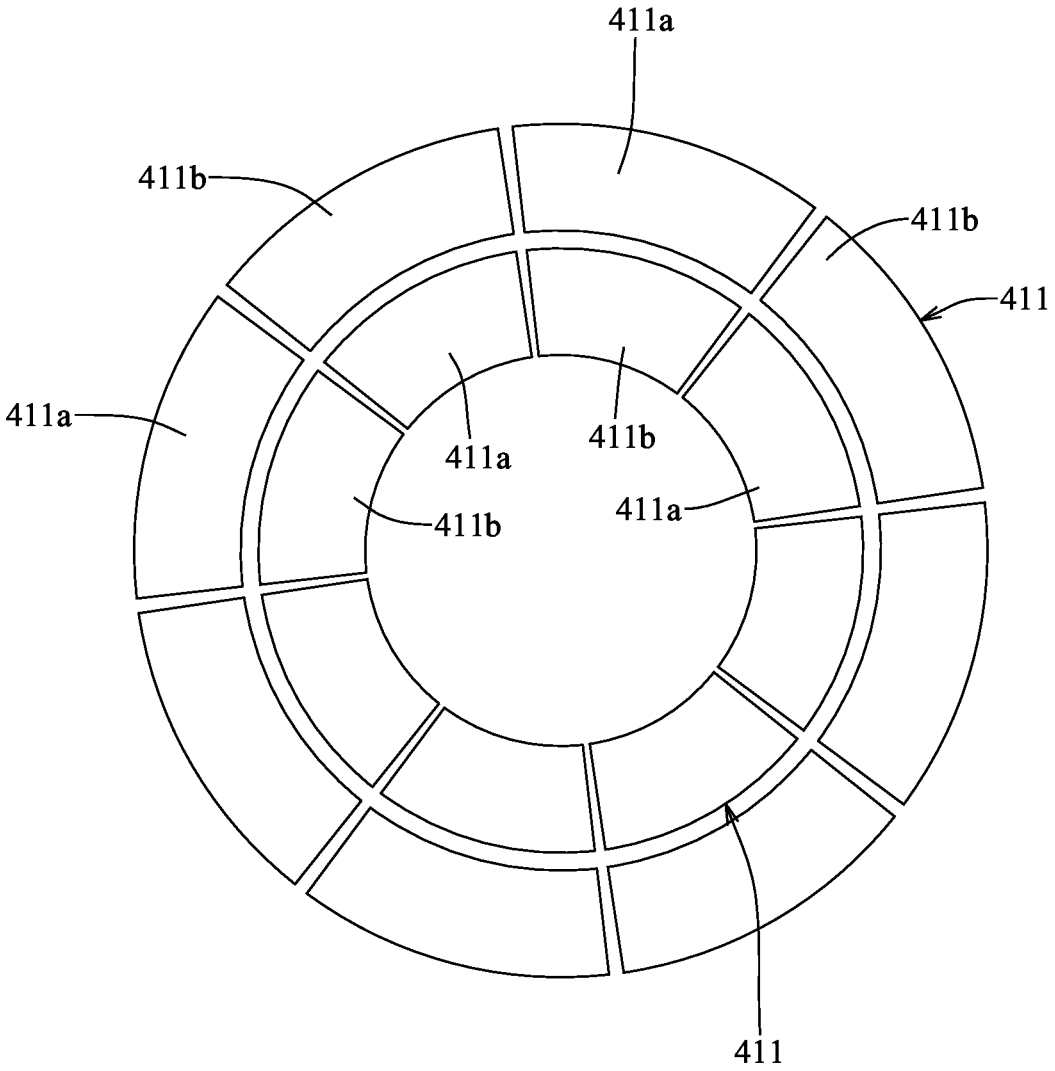
FIG. 7 is a schematic view of magnetic rings of magnetic coupling subunits of the modification of the magnetic actuator.

Referring further to FIGS. 5 to 7, a modification of the magnetic actuators 10 may include a magnetic coupling unit 4 with a different configuration. In the magnetic coupling unit 4 of the modification, each of the magnetic coupling subunits 41 includes a magnetic ring 411. A radius of the magnetic ring 411 of one of the magnetic coupling subunits 41 is longer than a radius of the magnetic ring 411 of the other one of the magnetic coupling subunits 41, and the magnetic rings 411 of the magnetic coupling subunits 41 are spaced apart from each other in a radial direction thereof. For each of the magnetic actuators 10, the one of the magnetic coupling subunits 41 that includes the magnetic ring 411 with a longer radius further includes a first outer casing 412A that is connected to the motor 2, and the other one of the magnetic coupling subunits 41 further includes a first interconnecting shaft 412B that is connected to the rotating shaft 31. The magnetic ring 411 of the one of the magnetic coupling subunits 41 is fixedly mounted to the first outer casing 412A. The magnetic ring 411 of the other one of the magnetic coupling subunits 41 is fixedly sleeved on the first interconnecting shaft 412B. In the magnetic coupling unit 4 of the modification, the N pole portions 411*a* of the magnetic ring 411 of one of the magnetic coupling subunits 41 respectively correspond in position to the S pole portions 411*b* of the magnetic ring 411 of the other one of the magnetic coupling subunits 41 (see FIG. 7). For each of the magnetic actuators 10, when the one of the magnetic coupling subunits 41 that has the first outer casing 412A is driven by the motor 2 to rotate, the other one of the magnetic coupling subunits 41 that has the first interconnecting shaft 412B is urged to rotate by magnetic attraction between the magnetic rings 411 of the magnetic coupling subunits 41 such that the rotating shaft 31 and the rotating member 32 rotate.

Figure 8:
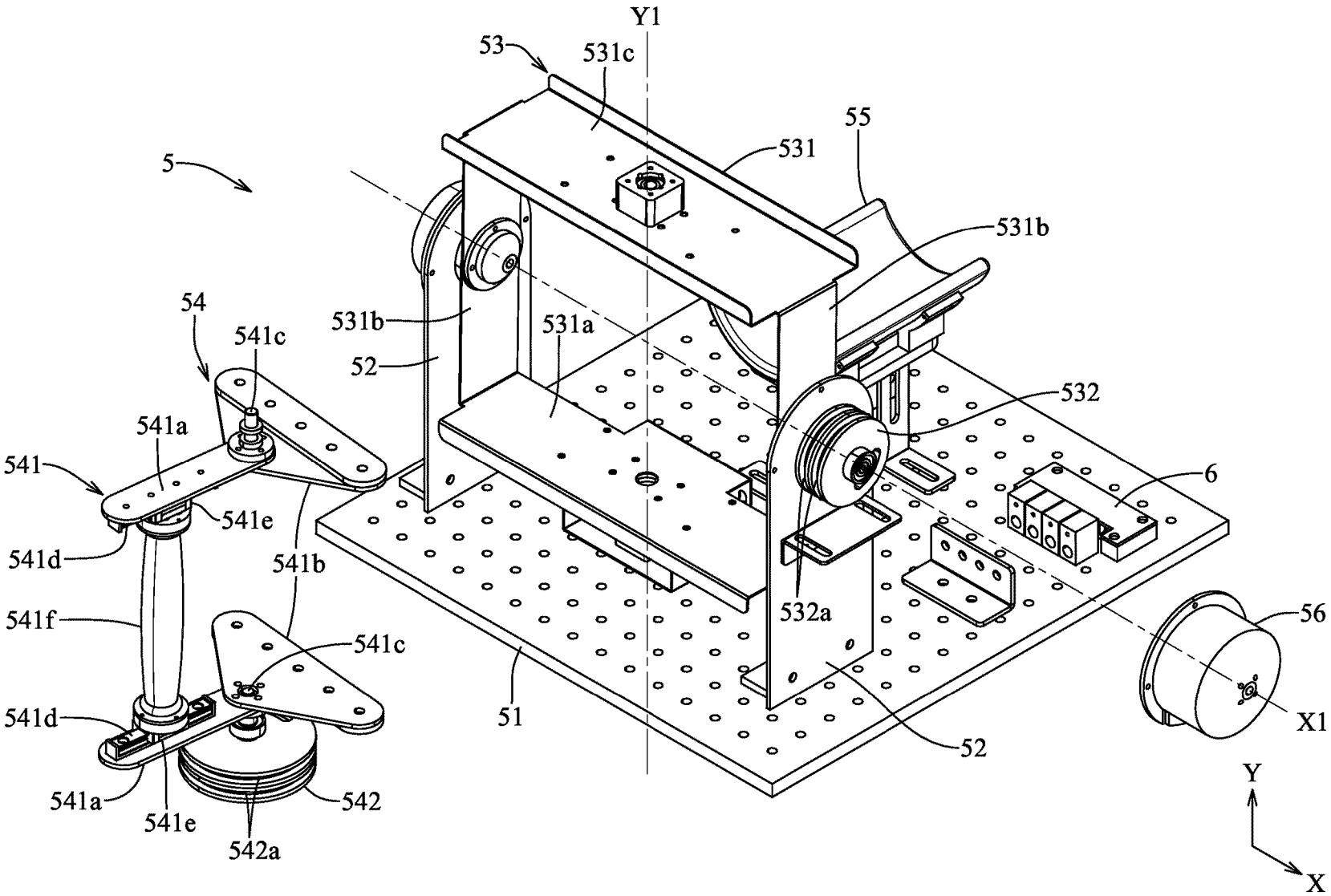
FIG. 8 is a partly exploded perspective view of a movable frame unit of the first embodiment.
Figure 9:
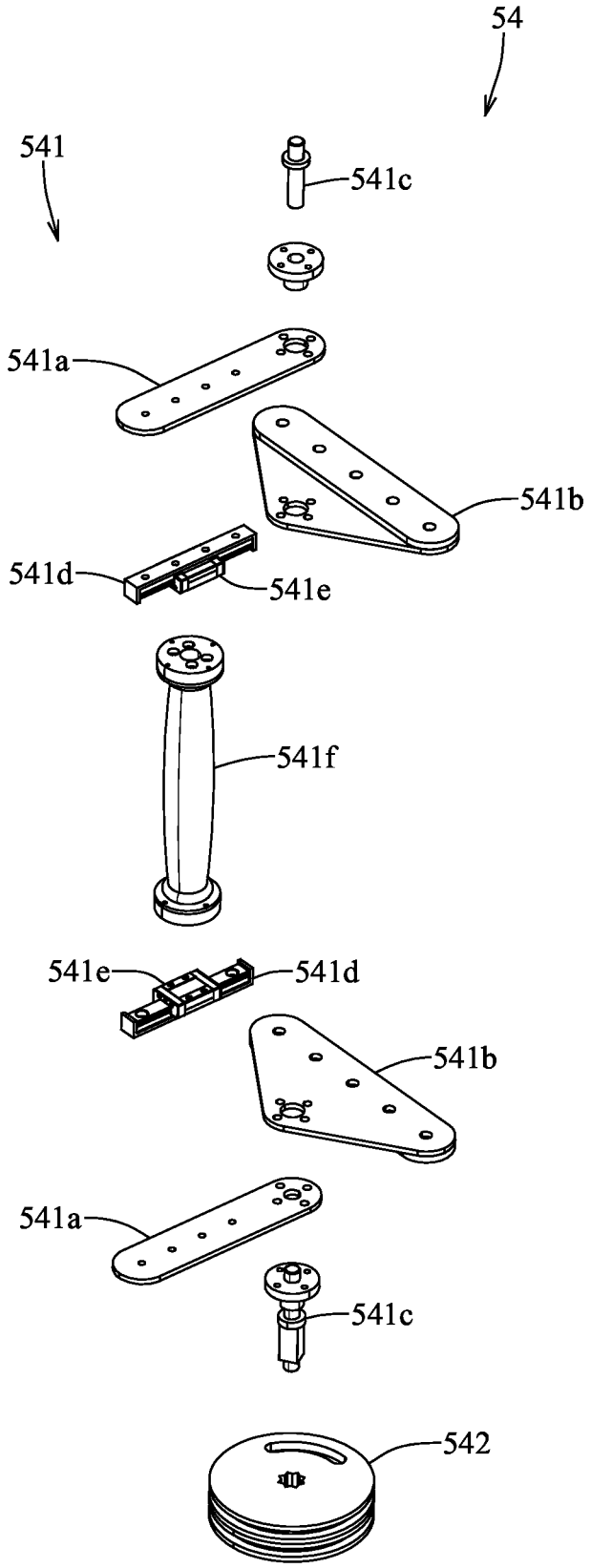
FIG. 9 is a partly exploded perspective view of a second movable frame of the movable frame unit.

Referring to FIGS. 8 and 9, in cooperation with FIG. 1, the movable frame unit 5 includes a base plate 51, two standing plates 52, a first movable frame 53, a second movable frame 54, a supporting frame 55, and a cover 56. The standing plates 52 are disposed on the base plate 51, and are spaced apart from each other in a first direction (X). The first movable frame 53 is rotatably mounted to the standing plates 52, and is rotatable relative to the standing plates 52 about a first axis (X1) that extends in the first direction (X). The second movable frame 54 is rotatably mounted to the first movable frame 53, and is rotatable relative to the first movable frame 53 about a second axis (Y1) of the first movable frame 53 orthogonal to the first axis (X1). The supporting frame 55 is disposed on the base plate 51, and is adapted for supporting an arm of the patient. The first movable frame 53 includes a first frame body 531, and a first rotation member 532 that is fixedly mounted to the first frame body 531 and that is rotatably mounted to one of standing plates 52. The cover 56 is disposed on the one of the standing plates 52 to which the first rotation member 532 is rotatably mounted, and covers the first rotation member 532 so that the first rotation member 532 may be protected by the cover 56. The first frame body 531 includes a lower plate 531*a*, two side plates 531*b* that are connected to the lower plate 531*a* and that are respectively and rotatably mounted to the standing plates 52, and an upper plate 531*c* that interconnects the side plates 531*b* and that is spaced apart from the lower plate 531*a*. The first rotation member 532 is fixedly mounted to one of the side plates 531*b*, and has two grooves 532*a* that are formed in an outer circumferential surface thereof. The cables (W) in one of the pairs wind around the grooves 532*a* of the first rotation member 532.

The second movable frame 54 includes a second frame body 541, and a second rotation member 542 that is fixedly mounted to the second frame body 541, that is rotatably mounted to the first frame body 531, and that is located below the lower plate 531*a* of the first frame body 531. The second frame body 541 includes two movable plates 541*a*, two wing plates 541*b*, two pivot shafts 541*c*, two slide rails 541*d*, two slide blocks 541*e*, and a handle 541*f*. The movable plates 541*a* are respectively connected to the lower plate 531*a* and the upper plate 531*c* of the first frame body 531. The wing plates 541*b* are respectively connected to the movable plates 541*a*. The slide rails 541*d* are respectively disposed on the movable plates 541*a*. The slide blocks 541*e* are respectively and movably disposed on the slide rails 541*d*. The handle 541*f* is fixedly mounted to the slide blocks 541*e*. One of the pivot shafts 541*c* extends through the second rotation member 542, the lower plate 531*a*, the respective one of the movable plates 541*a* that is connected to the lower plate 531*a*, and the respective one of the wing plates 541*b* that is connected to the respective one of the movable plates 541*a* which is connected to the lower plate 531*a*, and is connected to the second rotation member 542. The other one of the pivot shafts 541*c* extends through the upper plate 531*c*, the respective one of the movable plates 541*a* that is connected to the upper plate 531*c*, and the respective one of the wing plates 541*b* that is connected to the respective one of the movable plates 541*a* which is connected to the upper plate 531*c*. The pivot shafts 541*c* cooperatively define the second axis (Y1). The handle 541*f* is adapted to be gripped by the patient. By virtue of the slide blocks 541*e* being respectively and movably disposed on the slide rails 541*d*, and by virtue of the handle 541*f* being fixedly mounted to the slide blocks 541*e*, the patient may adjust a distance between the handle 541*f* and the supporting frame 55, according to a length of the patient's arm, via movements of the slide blocks 541*e* relative to the slide rails 541*d*. The second rotation member 542 has two grooves 542*a* that are formed in an outer circumferential surface thereof. The cables (W) in the other one of the pairs wind around the grooves 542*a* of the second rotation member 542.

The tension regulator 6 is disposed on the base plate 51.

The one of the pairs of the cables (W) interconnects the first rotation member 532 and one of the magnetic actuators 10 so that the first movable frame 53 is drivable by the one of the magnetic actuators 10 to rotate. The other one of the pair of the cables (W) interconnects the second rotation member 542 and the other one of the magnetic actuators 10 so that the second movable frame 54 is drivable by the other one of the magnetic actuators 10 to rotate. Each of the cables (W) in each of the pairs extends through the tension regulator 6 so that the tension regulator 6 is operable to adjust tension of each of the cables (W). When the patient grips the handle 541*f* and when the first movable frame 53 rotates relative to the standing plates 52, the wrist of the patient is urged to move toward an ulnar side of the wrist (i.e., ulnar deviation) or a radial side of the wrist (i.e., radial deviation) for wrist rehabilitation. In this embodiment, when the patient grips the handle 541*f* in a common manner, the wrist of the patient is urged to move upwardly when being urged to move toward the radial side, and is urged to move downwardly when being urged to move toward the ulnar side. When the patient grips the handle 541*f* with his/her left hand and when the second movable frame 54 rotates relative to the first movable frame 53, the wrist of the patient is urged to move toward a right side of the patient (i.e., extension of the wrist) or a left side of the patient (i.e., flexion of the wrist) for wrist rehabilitation.

By virtue of the rehabilitation device 100 transmitting torque from the motor 2 to the rotating shaft 31 via the magnetic coupling unit 4 of each of the magnetic actuators 10, and by virtue of the magnetic rings 411 of each of the magnetic coupling subunits 41 being spaced apart from each other, the magnetic actuators 10 may serve as elastic/soft actuators for the rehabilitation device 100, and elasticity of each of the magnetic actuators 10 may be easily adjusted by adjusting a distance between the magnetic rings 411 of the magnetic actuator 10. In addition, each of the magnetic actuators 10 may have a particular limit for its output no matter how great an input from the motor 2 thereof is. Therefore, a force that is generated by the rehabilitation device 100 and that is exerted on the patient may be limited without using an electric control device or a torque limiter so the patient is protected. Even when the magnetic rings 411 of each of the magnetic actuators 10 are misaligned, the angle position sensor 33 of the magnetic actuator 10 may detect misalignment between the magnetic rings 411 and compensate the misalignment. Thus, the rehabilitation device 100 may not stop operating because of overload protection when the magnetic rings 411 of any one of the magnetic actuators 10 are repeatedly misaligned so that there may be no need to reset the rehabilitation device 100, thereby preventing malfunction of the rehabilitation device 100 and preventing the patient from injuries. Moreover, a torque for the misalignment between the magnetic rings 411 of each of the magnetic actuators 10 may be easily adjusted by adjusting the distance between the magnetic rings 411 of the magnetic actuator 10 as well.

Generally, a conventional rehabilitation device that is common on the market is either for a therapy that involves continuous passive motion (CPM) in which the patient is urged by the conventional rehabilitation machine to move repetitively, or a therapy that involves active-resisted movement (ARM) and that helps the patient by providing weight training exercises. However, by virtue of each of the magnetic actuators 10 having adjustable elasticity, the rehabilitation device 100 may be operable to provide both of the therapies, which makes the rehabilitation device 100 multifunctional.

With predetermined magnetic parameters of each of the magnetic rings 411, the angle position sensor 33 of each of the magnetic actuators 10 may detect a load on each of the magnetic rings 411 of the magnetic actuator 10 according to the misalignment between the magnetic rings 411 of the magnetic actuator 10. Therefore, the angle position sensor 33 of each of the magnetic actuators 10 may serve as a force detector. Muscle tone of the patient may thus be detected and quantified so that the muscle tone may be evaluated when values thereof is analyzed.

Moreover, for each of the magnetic actuators 10, because the torque is transmitted from the motor 2 to the rotating shaft 31 by the attraction between the magnetic rings 411 that are spaced apart from each other, and because the magnetic parameters of each of the magnetic rings 411 may be predetermined, the magnetic rings 411 of the magnetic coupling subunits 41 may be adjusted to be misaligned when the torque that is transmitted from the motor 2 to the magnetic coupling subunit 41 connected to the motor 2 is greater than a predetermined limit torque that the magnetic coupling subunit 41 connected to the rotating shaft 31 may transmit. That is to say, each of the magnetic actuators 10 may have the particular limit for its output. Therefore, even when someone operates the rehabilitation device 100 in a wrong way, or when the rehabilitation device 100 accidentally malfunctions, the patient may still be protected from injuries. Such protection mechanism involving magnetic attraction may react faster and may be more trustworthy than a protection mechanism involving a system control software, an electric control device, or a force detector.

Figure 10:
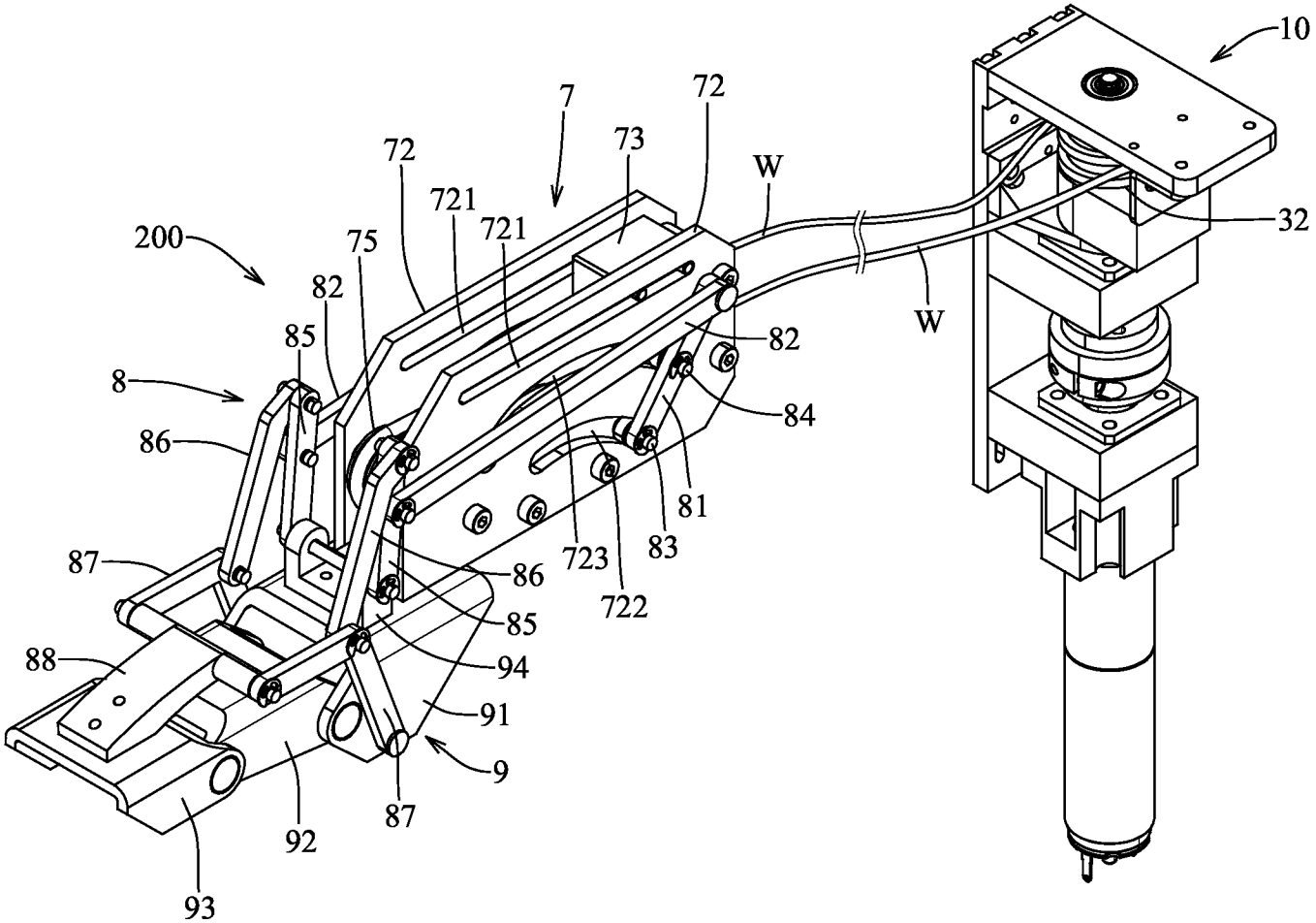
FIG. 10 is a fragmentary perspective view of a second embodiment of the rehabilitation device according to the disclosure.
Figure 11:
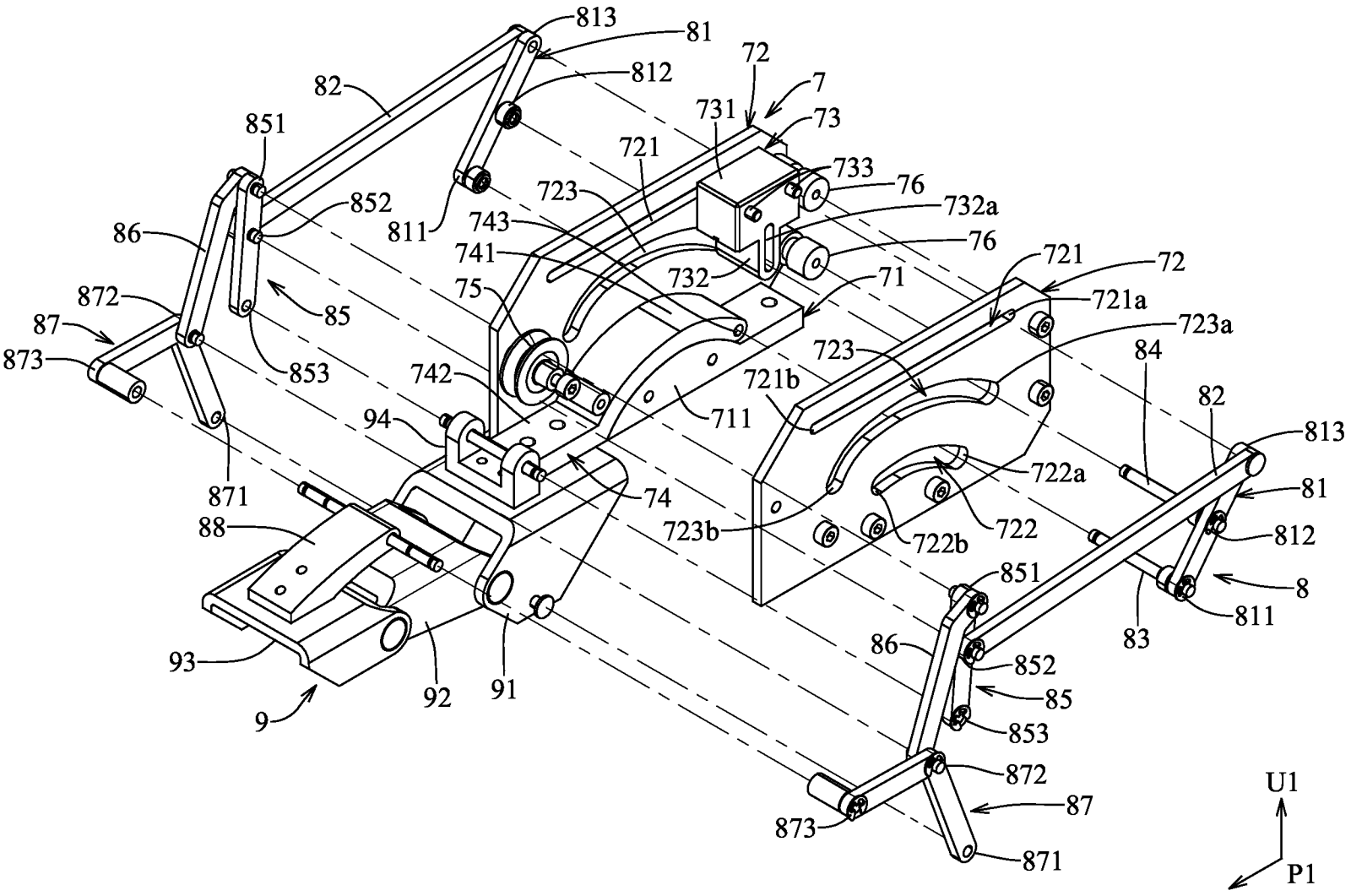
FIG. 11 is a partly exploded perspective view of part of the second embodiment.
Figure 12:
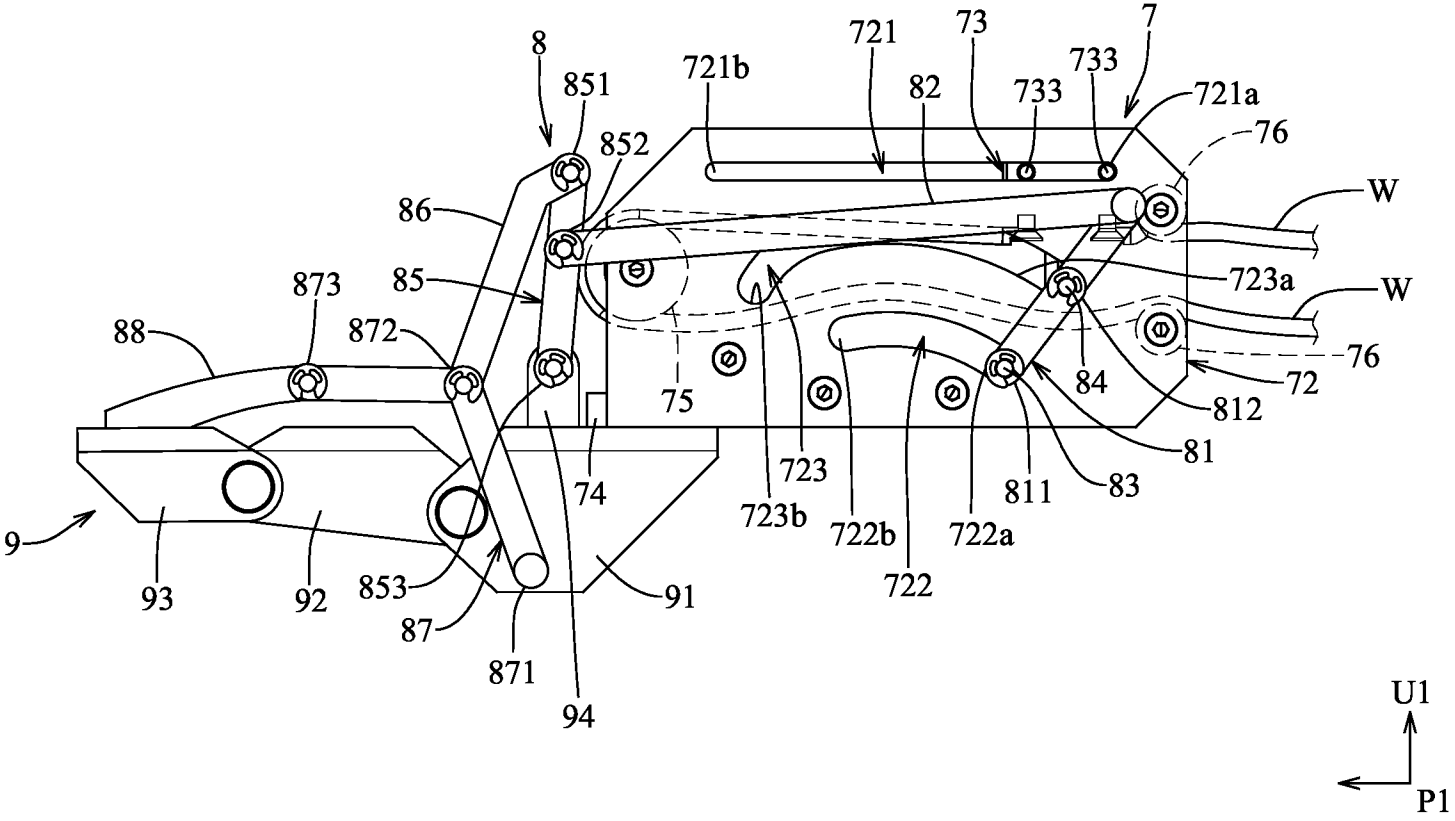
FIG. 12 is a fragmentary side view of the second embodiment.

Referring to FIGS. 10 to 12, a second embodiment of the rehabilitation device 200 is adapted for finger rehabilitation (i.e., the rehabilitation device 200 helps a patient to rehabilitate his/her finger). The rehabilitation device 200 includes one of the magnetic actuators 10 (hereinafter "the magnetic actuator 10") as mentioned above, a base frame unit 7, a linkage unit 8, a joint actuation unit 9, and two cables (W).

The base frame unit 7 includes a lower abutting plate 71, two side standing plates 72, a sliding block 73, a first pushing member 74, a front roller 75, and two rear rollers 76. The side standing plates 72 are disposed on the lower abutting plate 71 and are spaced apart from each other. The sliding block 73 is movably disposed between the side standing plates 72, and has two opposite ends. The first pushing member 74 is movably disposed on the lower abutting plate 71, and is connected to the joint actuation unit 9. The front roller 75 is disposed between the side standing plates 72. The rear rollers 76 are disposed between the side standing plates 72, and are opposite to the front roller 75. The lower abutting plate 71 has a curved protrusion 711 that is formed on an upper surface thereof. Each of the side standing plates 72 has a first slide slot 722 that is curved, a second slide slot 723 that is curved and that is located above the first slide slot 722, and a third slide slot 721 that is elongated in a plate direction (P1). The second slide slot 723 of each of the side standing plates 72 is located between the first slide slot 722 and the third slide slot 721 of the side standing plate 72. The third slide slot 721 of each of the side standing plates 72 has a first end 721*a* that is adjacent to the rear rollers 76, and a second end 721*b* that is opposite to the first end 721*a* in the plate direction (P1). A length of the second slide slot 723 of each of the side standing plates 72 is greater than a length of the first slide slot 722 of the side standing plate 72. The first slide slot 722 of each of the side standing plates 72 has a first end 722*a* that is adjacent to the rear rollers 76, and a second end 722*b* that is opposite to the first end 722*a* in the plate direction (P1). The second slide slot 723 of each of the side standing plates 72 has a first end 723*a* that is adjacent to the rear rollers 76, and a second end 723*b* that is opposite to the first end 723*a* in the plate direction (P1).

The sliding block 73 includes a block body portion 731 that is substantially cuboid and that has the ends of the sliding block 73, an insertion portion 732 that extends downwardly from the body portion 731, and four protrusions 733 (only two of the protrusions 733 are visible due to the viewing angle) that are formed at two opposite sides of the block body portion 731 and that extend into the slide slots 721 of the side standing plates 72. Specifically, two of the protrusions 733 extend into one of the slide slots 721, and the remaining two of the protrusions 733 extend into the other one of the slide slots 721. The insertion portion 732 has a through hole 732*a*. The first pushing member 74 has a curved segment 741 that is coupled to the protrusion 711 of the lower abutting plate 71, a connecting segment 742 that extends from the curved segment 741 and that is connected to the joint actuation unit 9, and a through hole 743 that extends through one end of the curved segment 741 opposite to the connecting segment 742. Each of the side standing plates 72 has two opposite ends that are respectively proximate to and distal from the joint actuation unit 9. The front roller 75 is located between the ends of the side standing plates 72 proximate to the joint actuation unit 9. The rear rollers 76 are located between the ends of the side standing plates 72 distal from the joint actuation unit 9, and are spaced apart from each other in an up-down direction (U1) orthogonal to the plate direction (P1). One of the cables (W) is fixedly mounted to one of the ends of the block body portion 731 of the sliding block 73, abuts against the upper one of the rear rollers 76, and interconnects the magnetic actuator 10 and the one of the ends of the block body portion 731. The other one of the cables (W) is fixedly mounted to the other one of the ends of the block body portion 731, extends around the front roller 75, abuts against the lower one of the rear rollers 76, and interconnects the magnetic actuator 10 and the other one of the ends of the sliding block 73. The cables (W) are operable to pull the sliding block 73 in opposite directions so that the sliding block 73 is movable along the third slide slot 721 in the plate direction (P1).

The linkage unit 8 interconnects the sliding block 73 and the first pushing member 74, and is movable relative to the base frame unit 7. The linkage unit 8 includes two slot-interconnecting links 81, two first links 82, a first slide rod 83, a second slide rod 84, two second links 85, two third links 86, two fourth links 87, and a second pushing member 88. Each of the first links 82 is rotatably connected to an end of a respective one of the slot-interconnecting links 81. The first slide rod 83 extends through the first slide slots 722 of the side standing plates 72 and the through hole 743 of the first pushing member 74, interconnects the slot-interconnecting rods 81, and is movable along the first slide slots 722. The second slide rod 84 extends through the second slide slots 723 of the side standing plates 72 and the through hole 732*a* of the sliding block 73, interconnects the slot-interconnecting links 81, and is movable along the second slide slots 723. Each of the second links 85 is rotatably connected to an end of a respective one of the first links 82. Each of the third links 86 is rotatably connected to an end of a respective one of the second links 85. Each of the fourth links 87 is rotatably connected to an end of a respective one of the third links 86. The second pushing member 88 is rotatably connected to an end of each of the fourth links 87. Each of the slot-interconnecting links 81 has a first pivot portion 811 that is rotatably connected to the first slide rod 83, a second pivot portion 812 that is rotatably connected to the second slide rod 84, and a third pivot portion 813 that is rotatably connected to the respective one of the first links 82. Each of the second links 85 has an upper connecting portion 851 that is rotatably connected to the respective one of the third links 86, a middle connecting portion 852 that is rotatably connected to the respective one of the first links 82, and a lower connecting portion 853. Each of the fourth links 87 is bent, and has a first linkage portion 871, a vertex portion 872 that is rotatably connected to the respective one of the third linkage rods 86, and a second linkage portion 873 that is rotatably connected to the second pushing member 88. Each of the fourth links 87 is bent at the vertex portion 872 thereof.

The joint actuation unit 9 is adapted for the finger of the patient to abut against. The joint actuation unit 9 interconnects the first pushing member 74 and the linkage unit 8. The joint actuation unit 9 is adapted to urge the finger of the patient to bend when being pushed by the pushing member 74 and the linkage unit 8. The joint actuation unit 9 includes a first actuation member 91, a second actuation member 92, a third actuation member 93, and a rotation seat 94. The first actuation member 91 is fixedly mounted to the first pushing member 74, and is rotatably connected to the first linkage portion 871 of each of the fourth links 87. The second actuation member 92 is rotatably mounted to the first actuation member 91. The third actuation member 93 is rotatably mounted to the second actuation member 92, and is fixedly mounted to the second pushing member 88. The rotation seat 94 is disposed on the first actuation member 91, is adjacent to the first pushing member 74, and has two opposite sides. The lower connecting portions 853 of the second links 85 are respectively and rotatably connected to the opposite sides of the rotation seat 94. For each of the second links 85, the upper connecting portion 851 is located at the end thereof opposite to the rotation seat 94 (i.e., each of the third links 86 is rotatably connected to the end of the respective one of the second links 85 opposite to the rotation seat 94). When the finger of the patient abuts against the joint actuation unit 9, the first, second, and third actuation members 91, 92, 93 respectively correspond in position to a proximal phalanx, a middle phalanx, and a distal phalanx of the finger. In addition, a junction between the first actuation member 91 and the first pushing member 74 substantially corresponds in position to a metacarpophalangeal joint of the finger, a junction between the second actuation member 92 and the first actuation member 91 substantially corresponds in position to a proximal interphalangeal joint of the finger, and a junction between the third actuation member 93 and the second actuation member 92 substantially corresponds in position to a distal interphalangeal joint of the finger.

Figure 13:
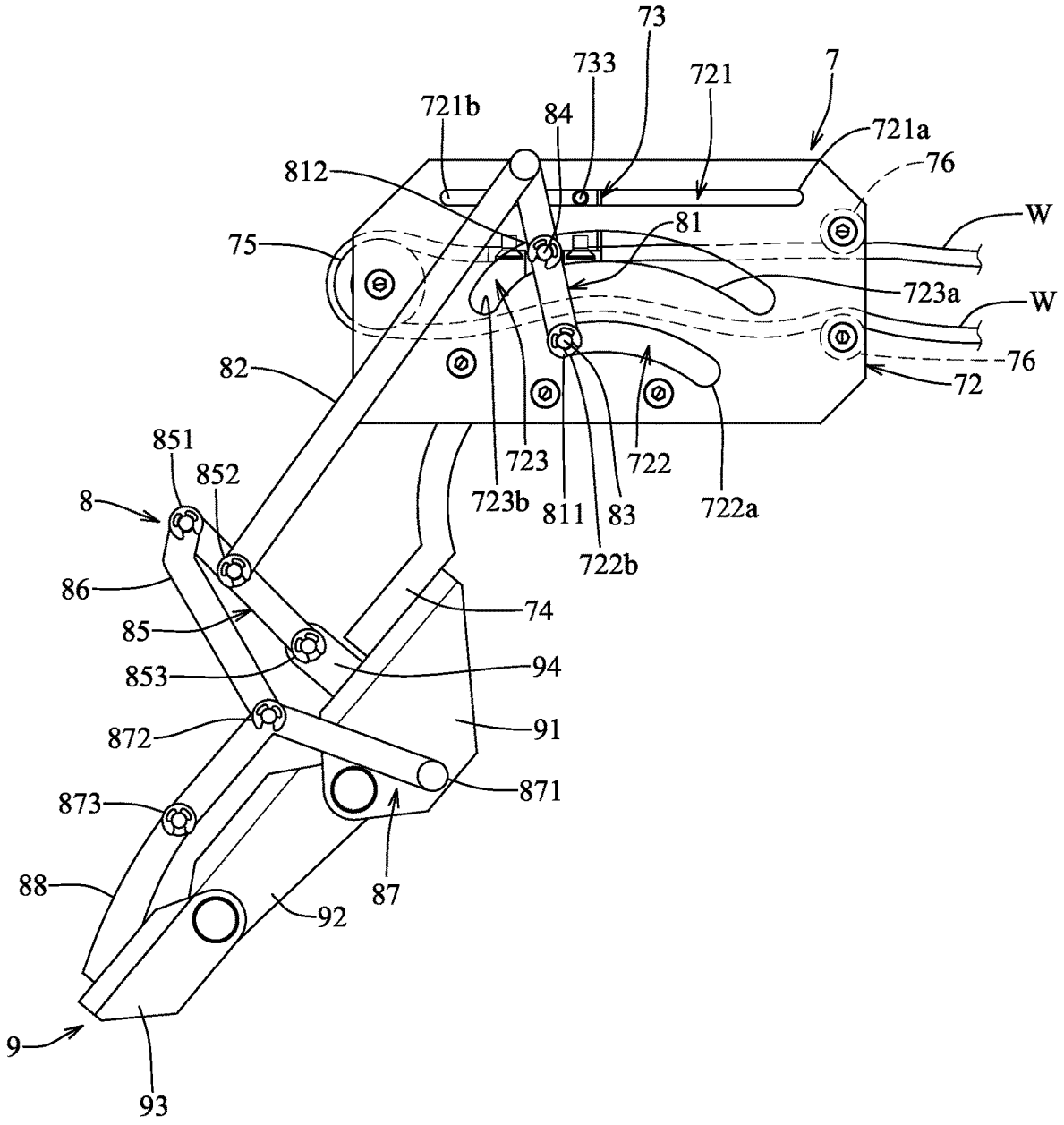
FIG. 13 is another fragmentary side view of the second embodiment.
Figure 14:
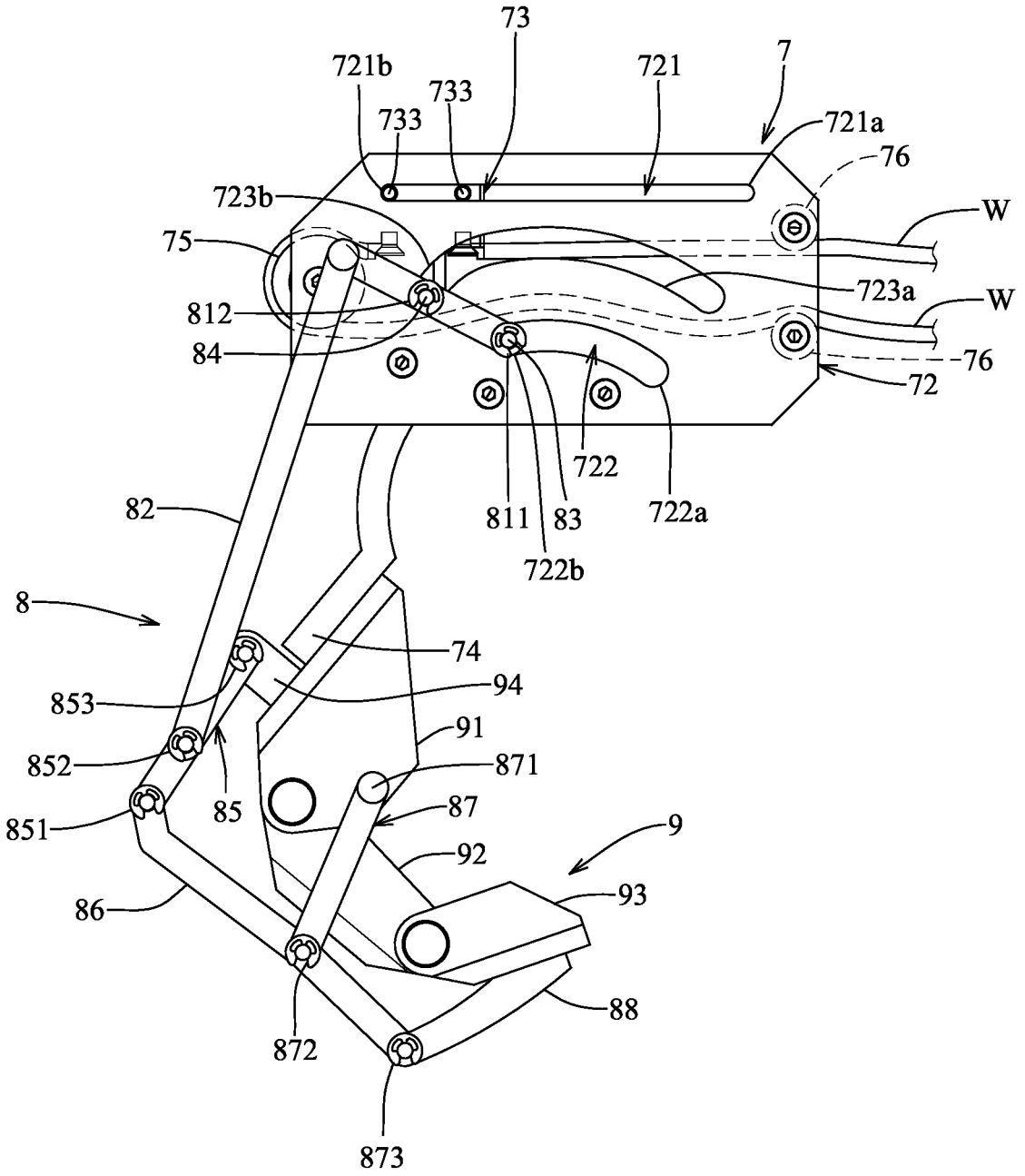
FIG. 14 is still another fragmentary side view of the second embodiment.

Referring to FIGS. 13 and 14, in cooperation with FIG. 12, via the cables (W), the magnetic actuator 10 is operable to urge the sliding block 73 to move along the third slide slot 721 so that the sliding block 73 urges the linkage unit 8 and the first pushing member 74 to move. The joint actuation unit 9 is adapted to urge the finger of the patient to bend when the linkage unit 8 and the first pushing member 74 are urged by the sliding block 73 to move, to push the joint actuation unit 9, and to urge the joint actuation unit 9 to bend. FIG. 12 shows an initial state of the rehabilitation device 200 without the magnetic actuator 10. When the rehabilitation device 200 is in the initial state, the protrusions 733 of the sliding block 73 are located at the first ends 721*a* of the slide slots 721, the first slid rod 83 is located at the first ends 722*a* of the first slide slots 722 such that the first pivot portions 811 of the slot-interconnecting links 81 are adjacent to the first ends 722*a* of the first slide slots 722, and the second slide rod 84 is located at the first ends 723*a* of the second slide slots 723 such that the second pivot portions 812 of the slot-interconnecting links 81 are adjacent to the first ends 723*a* of the second slide slots 723. At this time, the joint actuation unit 9 is straight. When the magnetic actuator 10 urges the other one of the cables (W) that extends around the front roller 75 to pull the other one of the ends of the block body portion 731 so as to move the sliding block 73, the insertion portion 732 of the sliding block 73 urges the second slide rod 84 to move such that the second slide rod 84 urges the slot-interconnecting links 81 to move and that the slot-interconnecting links 81 urge the rest of the linkage unit 8 to move. At this time, the first slide rod 83 is urged to move from the first ends 722*a* of the first slide slots 722 to the second ends 722*b* of the first slide slots 722, and urges the first pushing member 74 to move. By virtue of the curved segment 741 of the first pushing member 74 being coupled to the protrusion 711 of the lower abutting plate 71, and by virtue of each of the first and second slide slots 722, 723 being curved, each of the first and second slide rods 83, 84 moves in a curved path along the respective one of the first and second slide slots 722, 723, and the first pushing member 74 moves in a corresponding curved path along the protrusion 711 when being urged to move by the first slide rod 83. Referring to FIG. 13 again, when the first slide rod 83 is located at the second ends 722*a* of the first slide slots 722, the joint actuation unit 9 is still straight, but has been rotated relative to the base frame unit 7, thereby bending the metacarpophalangeal joint of the finger for finger rehabilitation. Referring to FIG. 14 again, afterwards, when the sliding block 73 is urged to move and then arrives at the second ends 721*b* of the slide grooves 721, and when the second slide rod 84 is urged to move and then arrives at the second ends 723*b* of the second slide slots 723, the slot-interconnecting links 81 respectively urge the first links 82 to respectively push the second links 85 downwardly such that each of the second links 85 rotates relative to the rotation seat 94. At this time, the second links 85 respectively urge the third links 86 to respectively push the fourth links 87 such that each of the fourth links 87 rotates relative to the first actuation member 91 about the first linkage portion 871 thereof. When the fourth links 87 rotate, the fourth links 87 push the second pushing member 88 such that the second pushing member 88 pushes the third actuation member 93. Consequently, the second actuation member 92 rotates relative to the first actuation member 91, and the third actuation member 93 rotates relative to the second actuation member 92, thereby bending the proximal interphalangeal joint and the distal interphalangeal joint of the finger for the finger rehabilitation.

In summary, by virtue of the magnetic actuator 10 transmitting the torque by the attraction between the magnetic rings 411 of the magnetic coupling subunits 41, and by virtue of the angle position sensor 33 detecting the load on each of the magnetic rings 411 according to the misalignment between the magnetic rings 411, the output of the magnetic actuator 10 may be adjusted when a rotational speed of the motor 2 is adjusted, and may be set to a predetermined value when the motor 2 is kept rotating at a specific speed. In addition, by adjusting the distance between the magnetic rings 411 of the magnetic actuator 10, by adjusting a distance among the magnetic pole portions in each of the magnetic rings 411, or by adjusting effective magnetic field between the magnetic rings 411, the attraction between the magnetic rings 411 may be adjusted so that the elasticity of the magnetic actuator 10 is adjusted, and that the output limit of the magnetic actuator 10 for the protection mechanism is also adjusted. That is to say, the force generated by the magnetic actuator 10 and exerted on the patient may be adjusted easily and swiftly, and therefore the purpose of the disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A magnetic actuator comprising:

a base seat;

a motor disposed on said base seat;

a rotating unit including a rotating shaft that is rotatably disposed on said base seat, a rotating member that is sleeved on said rotating shaft, and an angle position sensor that is sleeved on said rotating shaft; and a magnetic coupling unit connected to said motor and drivable by said motor to rotate, said magnetic coupling unit including two magnetic coupling subunits that are respectively connected to said motor and said rotating shaft, each of said magnetic coupling subunits including a magnetic ring that has a plurality of N pole portions and a plurality of S pole portions which are alternately arranged about a center of said magnetic ring, said N pole portions of said magnetic ring of one of said magnetic coupling subunits respectively corresponding in position to said S pole portions of said magnetic ring of the other one of said magnetic coupling subunits, when one of said magnetic coupling subunits that is connected to said motor is driven by said motor to rotate, the other one of said magnetic coupling subunits that is connected to said rotating shaft being urged to rotate by attraction between said magnetic rings of said magnetic coupling subunits such that said rotating shaft and said rotating member rotate.

2. The magnetic actuator as claimed in claim 1, wherein said rotating shaft is elongated in a longitudinal direction, and said magnetic rings are spaced apart from each other in the longitudinal direction.

3. The magnetic actuator as claimed in claim 2, wherein each of said magnetic coupling subunits further includes an outer housing that covers said magnetic ring thereof, and an interconnecting member, said interconnecting member of the one of said magnetic coupling subunits that is connected to said motor interconnecting said outer housing of the one of said magnetic coupling subunits and said motor, said interconnecting member of the other one of said magnetic coupling subunits that is connected said rotating shaft interconnecting said outer housing of the other one of said magnetic coupling subunits and said rotating shaft.

4. The magnetic actuator as claimed in claim 1, wherein a radius of said magnetic ring of one of said magnetic coupling subunits is longer than a radius of said magnetic ring of the other one of said magnetic coupling subunits, said magnetic rings of said magnetic coupling subunits being spaced apart from each other in a radial direction thereof.

5. The magnetic actuator as claimed in claim 4, wherein the one of said magnetic coupling subunits that includes said magnetic ring with a longer radius further includes a first outer casing that is connected to said motor, the other one of said magnetic coupling subunits further including a first interconnecting shaft that is connected to said rotating shaft, said magnetic ring of the one of said magnetic coupling subunits being fixedly mounted to said first outer casing, said magnetic ring of the other one of said magnetic coupling subunits being fixedly sleeved on said first interconnecting shaft.

6. The magnetic actuator as claimed in claim 1, wherein said base seat includes a main plate, a first bearing plate that is disposed on said main plate, and a second bearing plate that is disposed on said main plate and that is spaced apart from said first bearing plate, said motor being disposed on said first bearing plate, said rotating shaft extending through said second bearing plate, said magnetic coupling subunits being located between said first bearing plate and said second bearing plate.

7. The magnetic actuator as claimed in claim 6, wherein said base seat further includes a third bearing plate that is disposed on said main plate and that is spaced apart from said second bearing plate, said rotating shaft being inserted into said third bearing plate.

8. The magnetic actuator as claimed in claim 7, wherein said base seat further includes a mounting plate that is disposed on said main plate and that is located between said second bearing plate and said third bearing plate, said angle position sensor being disposed on said mounting plate, said rotating shaft extending through said mounting plate.

9. A rehabilitation device adapted for wrist rehabilitation, said rehabilitation device comprising:

two of said magnetic actuators of claim 1;

a movable frame unit including two standing plates that are spaced apart from each other in a first direction, a first movable frame that is rotatably mounted to said standing plates and that is rotatable relative to said standing plates about a first axis extending in the first direction, and a second movable frame that is rotatably mounted to said first movable frame and that is rotatable relative to said first movable frame about a second axis of said first movable frame orthogonal to the first axis, said first movable frame including a first frame body and a first rotation member that is fixedly mounted to said first frame body and that is rotatably mounted to one of said standing plates, said second movable frame including a second frame body and a second rotation member that is fixedly mounted to said second frame body, that is rotatably mounted to said first frame body, and that is located below said first frame body; and two pairs of cables, one of the pairs of said cables interconnecting said first rotation member and one of said magnetic actuators so that said first movable frame is drivable by the one of said magnetic actuators to rotate, the other one of the pairs of said cables interconnecting said second rotation member and the other one of said magnetic actuators so that said second movable frame is drivable by the other one of said magnetic actuators to rotate.

10. The rehabilitation device as claimed in claim 9, wherein said first frame body includes a lower plate, two side plates that are connected to said lower plate and that are respectively and rotatably mounted to said standing plates, and an upper plate that interconnects said side plates and that is spaced apart from said lower plate, said first rotation member being fixedly mounted to one of said side plates.

11. The rehabilitation device as claimed in claim 10, wherein said second frame body includes two movable plates that are respectively connected to said lower plate and said upper plate of said first frame body, two wing plates that are respectively connected to said movable plates, two pivot shafts, two slide rails that are respectively disposed on said movable plates, two slide blocks that are respectively and movably disposed on said slide rails, and a handle that is fixedly mounted to said slide blocks, one of said pivot shafts extending through said second rotation member, said lower plate, the respective one of said movable plates that is connected to said lower plate, and the respective one of said wing plates that is connected to the respective one of said movable plates which is connected to said lower plate, the other one of said pivot shafts extending through said upper plate, the respective one of said movable plates that is connected to said upper plate, and the respective one of said wing plates that is connected to the respective one of said movable plates which is connected to said upper plate.

12. The rehabilitation device as claimed in claim 9, wherein said movable frame unit further includes a base plate, and a supporting frame that is disposed on said base plate, said standing plates being disposed on said base plate.

13. A rehabilitation device adapted for finger rehabilitation, said rehabilitation device comprising:

said magnetic actuator as claimed in claim 1;

a base frame unit including a lower abutting plate, two side standing plates that are disposed on said lower abutting plate and that are spaced apart from each other, a sliding block that is movably disposed between said side standing plates and that has two opposite ends, and a first pushing member that is movably disposed on said lower abutting plate;

a linkage unit interconnecting said sliding block and said first pushing member, and movable relative to said base frame unit;

a joint actuation unit adapted for a finger of a patient to abut against, said joint actuation unit interconnecting said first pushing member and said linkage unit, said joint actuation unit being adapted to urge the finger of the patient to bend when being pushed by said first pushing member and said linkage unit; and two cables, one of said cables interconnecting said magnetic actuator and one of the ends of said sliding block, the other one of said cables interconnecting said magnetic actuator and the other one of the ends of said sliding block, said magnetic actuator being operable to urge said sliding block to move so that said sliding block urges said linkage unit and said first pushing member to move, said joint actuation unit being adapted to urge the finger of the patient to bend when said linkage unit and said first pushing member are urged by said sliding block to move, to push said joint actuation unit, and to urge said joint actuation unit to bend.

14. The rehabilitation device as claimed in claim 13, wherein said joint actuation unit includes a first actuation member that is fixedly mounted to said first pushing member, a second actuation member that is rotatably mounted to said first actuation member, and a third actuation member that is rotatably mounted to said second actuation member and that is connected to said linkage unit.

15. The rehabilitation device as claimed in claim 14, wherein said joint actuation unit further includes a rotation seat that is disposed on said first actuation member, each of said side standing plates having a first slide slot that is curved, and a second slide slot that is curved and that is located above said first slide slot, a length of said second slide slot of each of said side standing plates being greater than a length of said first slide slot of said side standing plate, said linkage unit including two slot-interconnecting links, two first links each of which is rotatably connected to an end of a respective one of said slot-interconnecting links, a first slide rod that extends through said first slide slots of said side standing plates and said first pushing member, that interconnects said slot-interconnecting rods, and that is movable along said first slide slots, a second slide rod that extends through said second slide slots of said side standing plates and said sliding block, that interconnects said slot-interconnecting links, and that is movable along said second slide slots, two second links each of which is rotatably connected to said rotation seat and is rotatably connected to an end of a respective one of said first links, two third links each of which is rotatably connected to an end of a respective one of said second links opposite to said rotation seat, two fourth links each of which is rotatably connected to said first actuation member and an end of a respective one of said third links, and a second pushing member that is fixedly mounted to said third actuation member and that is rotatably connected to an end of each of said fourth links.

16. The rehabilitation device as claimed in claim 15, wherein each of said slot-interconnecting links has a first pivot portion that is rotatably connected to said first slide rod, a second pivot portion that is rotatably connected to said second slide rod, and a third pivot portion that is rotatably connected to the respective one of said first links, each of said second links having an upper connecting portion that is rotatably connected to the respective one of said third links, a middle connecting portion that is rotatably connected to the respective one of said first links, and a lower connecting portion that is rotatably connected to said rotation seat, each of said fourth links being bent, and having a first linkage portion that is rotatably connected to said first actuation member, a vertex portion that is rotatably connected to the respective one of said third linkage rods, and a second linkage portion that is rotatably connected to said second pushing member, each of said fourth links being bent at said vertex portion thereof.

17. The rehabilitation device as claimed in claim 15, wherein each of said side standing plates has a third slide slot that is elongated in a plate direction, said sliding block including a block body portion that has the ends of said sliding block, an insertion portion that extends downwardly from said block body portion, and a plurality of protrusions that are formed at two opposite sides of said block body portion and that extend into said third slide slots of said side standing plates, said insertion portion having a through hole, said second slide rod extending through said through hole of said sliding block, the one of said cables being fixedly mounted to the one of the ends of said block body portion of said sliding block, the other one of said cables being fixedly mounted to the other one of the ends of said block body portion, said cables being operable to pull said sliding block in opposite directions so that said sliding block being movable along said third slide slot in the plate direction.

18. The rehabilitation device as claimed in claim 13, wherein said base frame unit further includes a front roller that is disposed between said side standing plates, and two rear rollers that are disposed between said side standing plates and that are opposite to said front roller, each of said side standing plates having two opposite ends that are respectively proximate to and distal from said joint actuation unit, said front roller being located between the ends of said side standing plates proximate to said joint actuation unit, said rear rollers being located between the ends of said side standing plates distal from said joint actuation unit, the one of said cables abutting against one of said rear rollers and being fixedly connected to the one of the ends of said sliding block, the other one of said cables abutting against the other one of said rear rollers, extending around said front roller, and being fixedly connected to the other one of the ends of said sliding block.

* * * * *